US008787808B2

(12) United States Patent
Fukaya

(10) Patent No.: US 8,787,808 B2
(45) Date of Patent: Jul. 22, 2014

(54) FIXING DEVICE INCLUDING FIXING MEMBERS FOR APPLYING PRESSURE ON A CONVEYED SHEET

(75) Inventor: Mamoru Fukaya, Nagoya (JP)

(73) Assignee: Konica Minolta, Inc., Tokyo (JP)

( * ) Notice: Subject to any disclaimer, the term of this patent is extended or adjusted under 35 U.S.C. 154(b) by 845 days.

(21) Appl. No.: 12/144,116

(22) Filed: Jun. 23, 2008

(65) Prior Publication Data

US 2009/0041516 A1 Feb. 12, 2009

(30) Foreign Application Priority Data

Jun. 22, 2007 (JP) ..... 2007-164708

(51) Int. Cl.
*G03G 15/20* (2006.01)

(52) U.S. Cl.
USPC ..... 399/333

(58) Field of Classification Search
USPC ..... 399/333, 122, 328–330
See application file for complete search history.

(56) References Cited

U.S. PATENT DOCUMENTS 5,504,695 A * 4/1996 Yoshida et al. ..... 702/170
5,722,026 A * 2/1998 Goto et al. ..... 399/333
5,753,348 A * 5/1998 Hatakeyama et al. ..... 428/195.1
5,999,788 A * 12/1999 Kanesawa et al. ..... 399/329
7,146,126 B2 * 12/2006 Yoshii et al. ..... 399/329
2004/0131401 A1 * 7/2004 Nakatogawa et al. ..... 399/328
2005/0013639 A1 1/2005 Komuro et al.
2008/0152404 A1 * 6/2008 Yoshino et al. ..... 399/329

FOREIGN PATENT DOCUMENTS

JP 09-126225 5/1997
JP 11-133776 5/1999
JP 2003-005555 1/2003
JP 2004-287152 10/2004
JP 2005-037829 2/2005
JP 2006-010832 A 1/2006
WO WO-99/59034 11/1999

OTHER PUBLICATIONS

Machine English Translation of JP 2006-010832 published Jan. 12, 2006.*
Japanese Office Action, mailed Apr. 28, 2009, directed to counterpart Japanese Patent Application No. 2007-164708; 8 pages.

* cited by examiner

*Primary Examiner* — Billy Lactaoen
(74) *Attorney, Agent, or Firm* — Holtz Holtz Goodman & Chick PC

(57) ABSTRACT

There are provided two members which respectively have a form of a cylindrical roller or an endless belt and which are put in pressure contact with each other so as to form a nip section for fixation. There is provided a heating source which heats at least one of the two members to fixing temperature. In an end section corresponding to a downstream side of a nip section with respect to a sheet conveyance direction, one member out of the two members is curved in a state of protruding toward the other member. The one member has a surface made of fluorine-based resin, and an arithmetic average roughness of the surface is in a range of 0.1 μm to 1.3 μm.

7 Claims, 7 Drawing Sheets

*Fig.8*

| No. | SURFACE LAYER OF PRESSURE BELT | | | QUALITY | | |
|---|---|---|---|---|---|---|
| | MATERIAL | ADDITIVE | SURFACE ROUGHNESS:Ra(μm) | RELEASABILITY | SEPARATING PROPERTY | INITIAL IMAGE NOISE |
| 1 | FLUORINE-BASED RESIN | NON | 0.01 | ○ | × | ○ |
| 2 | FLUORINE-BASED RESIN | NON | 0.05 | ○ | △ | ○ |
| 3 | FLUORINE-BASED RESIN | NON | 0.10 | ○ | ○ | ○ |
| 4 | FLUORINE-BASED RESIN | NON | 0.70 | ○ | ○ | ○ |
| 5 | FLUORINE-BASED RESIN | NON | 1.30 | ○ | ○ | ○ |
| 6 | FLUORINE-BASED RESIN | NON | 1.50 | ○ | ○ | △ |
| 7 | FLUORINE-BASED RESIN | NON | 2.00 | ○ | ○ | × |
| 8 | FLUORINE-BASED RESIN | ADDED | 0.02 | × | × | ○ |
| 9 | FLUORINE-BASED RESIN | ADDED | 0.60 | × | ○ | ○ |
| 10 | FLUORINE-BASED RESIN | ADDED | 1.20 | × | ○ | ○ |
| 11 | FLUORINE-BASED RESIN | ADDED | 1.80 | × | ○ | × |

○ : SATISFACTORY △ : RATHER POOR × : POOR

FIXING DEVICE INCLUDING FIXING MEMBERS FOR APPLYING PRESSURE ON A CONVEYED SHEET

This application is based on an application No. 2007-164708 filed in Japan, the contents of which are hereby incorporated by reference.

BACKGROUND OF THE INVENTION

The present invention relates to a fixing device, and more specifically relates to a fixing device for applying pressure and heat to a sheet with toner attached to one surface thereof so as to melt the toner and thereby fix an image onto the sheet.

The present invention also relates to a manufacturing method for component members of such a fixing device.

The present invention further relates to an image forming apparatus having such a fixing device.

This kind of fixing device includes two members which are put in pressure contact with each other so as to form a nip section for fixation, and a heating source which heats at least one of the two members, in which sheets (e.g., paper) with toner attached to one surface thereof are conveyed through the nip section, so that the toner is melted through application of pressure and heat, and thereby an image is fixed to the sheets.

In the general fixing device, the two members have a smooth surface (with arithmetic average roughness Ra being 0.05 μm or less) which is made of fluorine-based resin such as PTFE (polytetrafluoroethylene) in order to enhance releasability of toner and paper powder.

It has conventionally been proposed to use fluorine-based resin containing carbon black (content ratio of fluorine-based resin is 95% or more) for the surface layer of belts used for forming the nip section (see e.g., JP 2003-5555 A). This prevents fixing belts from being charged and thereby prevents generation of electrostatic offset and the like.

SUMMARY OF THE INVENTION

However, since two members which form a nip section has a smooth surface, the above-mentioned general fixing device has a problem of jam generation (a problem of sheet separating property) as a sheet is wound around one member out of the two members, particularly the member in the state of protruding toward the other member. For example, in the case where one member has a section protruding to the other member for separation of sheets at the downstream end section of the nip section, a sheet would wind around the one member, and causes the jam problem.

When an additive is added to the fluorine-based resin forming the surface layer of belts as disclosed in JP 2003-5555 A, the surface unevenness is too large, which deteriorates the releasability of toner and paper powder and causes a problem in which toner and paper powder adhere to the surface (problem of releasability of toner and paper powder). As a consequence, the shape of attached substances is transferred onto images, which generates image noise and deteriorates image quality. Moreover, the attached substances may scratch the surface of the other member (component member of the nip section), which generates image noise and deteriorates image quality in a similar manner. Moreover, since adhering toner exists in a molten state, a jam by winding is generated and paper feed reliability is degraded.

Accordingly, an object of the present invention is to provide a fixing device capable of improving a sheet separating property as well as improving releasability of toner and paper powder in order to satisfy image quality and paper feed reliability.

Another object of the present invention is to provide a manufacturing method for component members of such a fixing device.

Yet another object of the present invention is to provide an image forming apparatus having such a fixing device.

In order to accomplish the above objects, a fixing device of a first aspect of the present invention comprises:

two members which respectively have a form of a cylindrical roller or an endless belt and which are put in pressure contact with each other so as to form a nip section for fixation; and a heating source which heats at least one of the two members to fixing temperature, wherein in an end section corresponding to a downstream side of the nip section with respect to a conveyance direction of a sheet which is conveyed through the nip section, one member of the two members is curved in a state of protruding toward the other member in a cross sectional view as viewed along a width direction of the sheet, and wherein the one member has a surface made of fluorine-based resin, and an arithmetic average roughness of the surface is in a range of 0.1 μm to 1.3 μm.

The term "fluorine-based resin" is a general name of synthetic resins which include a fluorine atom in their composition.

The surface arithmetic average roughness is a value expressed in micrometers (μm) obtained by the following equation (Equation 1) when a portion of a reference length is extracted from a roughness curve in the direction of its mean line, and the roughness curve is expressed as y=f(x) wherein an x axis denotes the mean line direction of the extracted portion and a y axis denotes a longitudinal magnification direction:

$$Ra = \frac{1}{l}\int_0^l |f(x)|dx \qquad \text{(Equation 1)}$$

In the fixing device in the first aspect, in an end section corresponding to a downstream side of the nip section with respect to a conveyance direction of a sheet which is conveyed through the nip section, one member of the two members is curved in a state of protruding toward the other member in a cross sectional view as viewed along a width direction of the sheet. Accordingly, during fixing operation, the sheet may tend to curve toward the one member and wind therearound. In the fixing device of the first aspect, the one member has a surface made of fluorine-based resin, and an arithmetic average roughness (Ra) of the surface is in a range of 0.1 μm to 1.3 μm. Thus, the surface of the one member is made of fluorine-based resin, and the surface has such unevenness as the arithmetic average roughness (Ra) of 0.1 μm or more, so that the sheet separating property can be improved. Furthermore, since the arithmetic average roughness (Ra) of the surface is 1.3 μm or less, the releasability of toner and paper powder can be improved. As a result, generation of image noise and generation of the jam by winding caused by melting of toner can be prevented, and thereby the image quality and the paper feed reliability can be satisfied.

A fixing device of a second aspect of the present invention comprises:

a fixing member which has a form of a cylindrical roller and whose outer circumference face is brought into pressure contact with a conveyed sheet; and a heating source which heats the fixing member to fixing temperature, wherein the fixing member has a surface made of fluorine-based resin, and an arithmetic average roughness of the surface is in a range of 0.1 μm to 1.3 μm.

In the fixing device in the second aspect, during fixing operation, sheets may tend to curve toward the fixing member and wind therearound. In the fixing device of the present invention, the fixing member has a surface made of fluorine-based resin, and an arithmetic average roughness (Ra) of the surface is in a range of 0.1 μm to 1.3 μm. Thus, the surface of the fixing member is made of fluorine-based resin, and the surface has such unevenness as the arithmetic average roughness (Ra) of 0.1 μm or more, so that the sheet separating property can be improved. Furthermore, since the arithmetic average roughness (Ra) of the surface is 1.3 μm or less, the releasability of toner and paper powder can be improved. As a result, generation of image noise and generation of the jam by winding caused by melting of toner can be prevented, and thereby the image quality and the paper feed reliability can be satisfied.

A manufacturing method of a third aspect of the present invention for manufacturing one member out of the two members comprised in a fixing device, the fixing device comprising the two members which respectively have a form of a cylindrical roller or an endless belt and which are put in pressure contact with each other so as to form a nip section for fixation, and a heating source which heats at least one of the two members to fixing temperature, comprises:

preparing a base material which has a form of a cylindrical roller or an endless belt;

laminating fluorine-based resin as a surface layer so as to cover an outer circumference face of the base material; and roughening a surface of the fluorine-based resin so that an arithmetic average roughness of the surface is in a range of 0.1 μm to 1.3 μm.

According to the manufacturing method of the third aspect, the one member can easily be manufactured.

A manufacturing method of a fourth aspect of the present invention for manufacturing one member out of the two members comprised in a fixing device, the fixing device comprising the two members which respectively have a form of a cylindrical roller or an endless belt and which are put in pressure contact with each other so as to form a nip section for fixation, and a heating source which heats at least one of the two members to fixing temperature, comprises:

forming a tube which is made of fluorine-based resin having a smooth surface by extrusion molding;

roughening a surface of the tube so that an arithmetic average roughness of the surface is in a range of 0.1 μm to 1.3 μm; and preparing a base material which has a form of a cylindrical roller or an endless belt and attaching the tube as a surface layer so as to cover an outer circumference face of the base material.

According to the manufacturing method of the fourth aspect, the one member can easily be manufactured.

A manufacturing method of a fifth aspect of the present invention for manufacturing one member out of the two members comprised in a fixing device, the fixing device comprising the two members which respectively have a form of a cylindrical roller or an endless belt and which are put in pressure contact with each other so as to form a nip section for fixation, and a heating source which heats at least one of the two members to fixing temperature, comprises:

forming a tube which is made of fluorine-based resin having a surface whose arithmetic average roughness is in a range of 0.1 μm to 1.3 μm by extrusion molding; and preparing a base material which has a form of a cylindrical roller or an endless belt and attaching the tube as a surface layer so as to cover an outer circumference face of the base material.

According to the manufacturing method of the fifth aspect, the one member can easily be manufactured.

A manufacturing method of a sixth aspect of the present invention for manufacturing one member out of the two members comprised in a fixing device, the fixing device comprising the two members which respectively have a form of a cylindrical roller or an endless belt and which are put in pressure contact with each other so as to form a nip section for fixation, and a heating source which heats at least one of the two members to fixing temperature, the manufacturing method comprises:

preparing a base material which has a form of a cylindrical roller or an endless belt having a smooth surface and roughening an outer circumference face of the base material to a predetermined roughness;

forming a tube which is made of fluorine-based resin having a smooth surface by extrusion molding; and attaching the tube as a surface layer to an outer circumference face of the base material for obtaining the one member including the base material and the tube, wherein the predetermined roughness is determined so that an arithmetic average roughness of the surface is set in a range of 0.1 to 1.3 μm with a shape of the outer circumference face of the base material being reflected upon a surface of the tube.

According to the manufacturing method of the sixth aspect, the one member can easily be manufactured.

A manufacturing method of a seventh aspect of the present invention for manufacturing a fixing member comprised in a fixing device, the fixing device comprising the fixing member which has a form of a cylindrical roller and whose outer circumference face is brought into pressure contact with a conveyed sheet, and a heating source which heats the fixing member to fixing temperature, comprises:

preparing a base material which has a form of a cylindrical roller;

laminating fluorine-based resin as a surface layer so as to cover an outer circumference face of the base material; and roughening a surface of the fluorine-based resin so that an arithmetic average roughness of the surface is in a range of 0.1 μm to 1.3 μm.

According to the manufacturing method of the seventh aspect, the fixing member can easily be manufactured.

A manufacturing method of a eighth aspect of the present invention for manufacturing a fixing member comprised in a fixing device, the fixing device comprising the fixing member which has a form of a cylindrical roller and whose outer circumference face is brought into pressure contact with a conveyed sheet, and a heating source which heats the fixing member to fixing temperature, comprises:

forming a tube which is made of fluorine-based resin having a smooth surface by extrusion molding;

roughening a surface of the tube so that an arithmetic average roughness of the surface is in a range of 0.1 μm to 1.3 μm; and preparing a base material which has a form of a cylindrical roller and attaching the tube as a surface layer so as to cover an outer circumference face of the base material.

According to the manufacturing method of the eighth aspect, the fixing member can easily be manufactured.

A manufacturing method of a ninth aspect of the present invention for manufacturing a fixing member comprised in a fixing device, the fixing device comprising the fixing member which has a form of a cylindrical roller and whose outer circumference face is brought into pressure contact with a conveyed sheet, and a heating source which heats the fixing member to fixing temperature, comprises:

forming a tube which is made of fluorine-based resin having a surface whose arithmetic average roughness is in a range of 0.1 μm to 1.3 μm by extrusion molding; and preparing a base material which has a form of a cylindrical roller and attaching the tube as a surface layer so as to cover an outer circumference face of the base material.

According to the manufacturing method of the ninth aspect, the fixing member can easily be manufactured.

A manufacturing method of a tenth aspect of the present invention for manufacturing a fixing member comprised in a fixing device, the fixing device comprising the fixing member which has a form of a cylindrical roller and whose outer circumference face is brought into pressure contact with a conveyed sheet, and a heating source which heats the fixing member to fixing temperature, comprises:

preparing a base material which has a form of a cylindrical roller, the base material having an outer circumference face with a predetermined roughness;

forming a tube which is made of fluorine-based resin having a smooth surface by extrusion molding; and attaching the tube as a surface layer to an outer circumference face of the base material for obtaining the one member including the base material and the tube, wherein the predetermined roughness is determined so that an arithmetic average roughness of the surface is set in a range of 0.1 to 1.3 μm with a shape of the outer circumference face of the base material being reflected upon a surface of the tube.

According to the manufacturing method of the tenth aspect, the fixing member can easily be manufactured.

An image forming apparatus of a eleventh aspect of the present invention comprises:

an image forming section for attaching toner to a sheet; and a fixing device comprising two members which respectively have a form of a cylindrical roller or an endless belt and which are put in pressure contact with each other so as to form a nip section for fixing the toner onto the sheet, and a heating source which heats at least one of the two members to fixing temperature, wherein in an end section corresponding to a downstream side of the nip section with respect to a conveyance direction of the sheet which is conveyed through the nip section, one member of the two members is curved in a state of protruding toward the other member in a cross sectional view as viewed along a width direction of the sheet, and wherein the one member has a surface made of fluorine-based resin, and an arithmetic average roughness of the surface is in a range of 0.1 μm to 1.3 μm.

An image forming apparatus of a twelfth aspect of the present invention comprises:

an image forming section for attaching toner to a sheet; and a fixing device comprising a fixing member which has a form of a cylindrical roller and whose outer circumference face is brought into pressure contact with a conveyed sheet, and a heating source which heats the fixing member to fixing temperature, wherein the fixing member has a surface made of fluorine-based resin, and an arithmetic average roughness of the surface is in a range of 0.1 μm to 1.3 μm.

In the image forming apparatuses of the eleventh and twelfth aspects, the image forming section attaches toner to a sheet, and then, the fixing device melts the toner and fixes an image onto the sheet. According to the image forming apparatus of the present invention, as with the fixing device as mentioned above, the sheet separating property is improved, and further the releasability of toner and paper powder is also improved. As a result, generation of image noise and generation of the jam by winding caused by melting of toner can be prevented, and thereby the image quality and the paper feed reliability can be satisfied.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 8 is a view showing an experimental result which shows the effect of the surface roughness of the pressure belt in FIG. 2A.

DETAILED DESCRIPTION OF THE INVENTION

Hereinbelow, the present invention will be described in details in conjunction with the embodiments with reference to the drawings.

Figure 1:
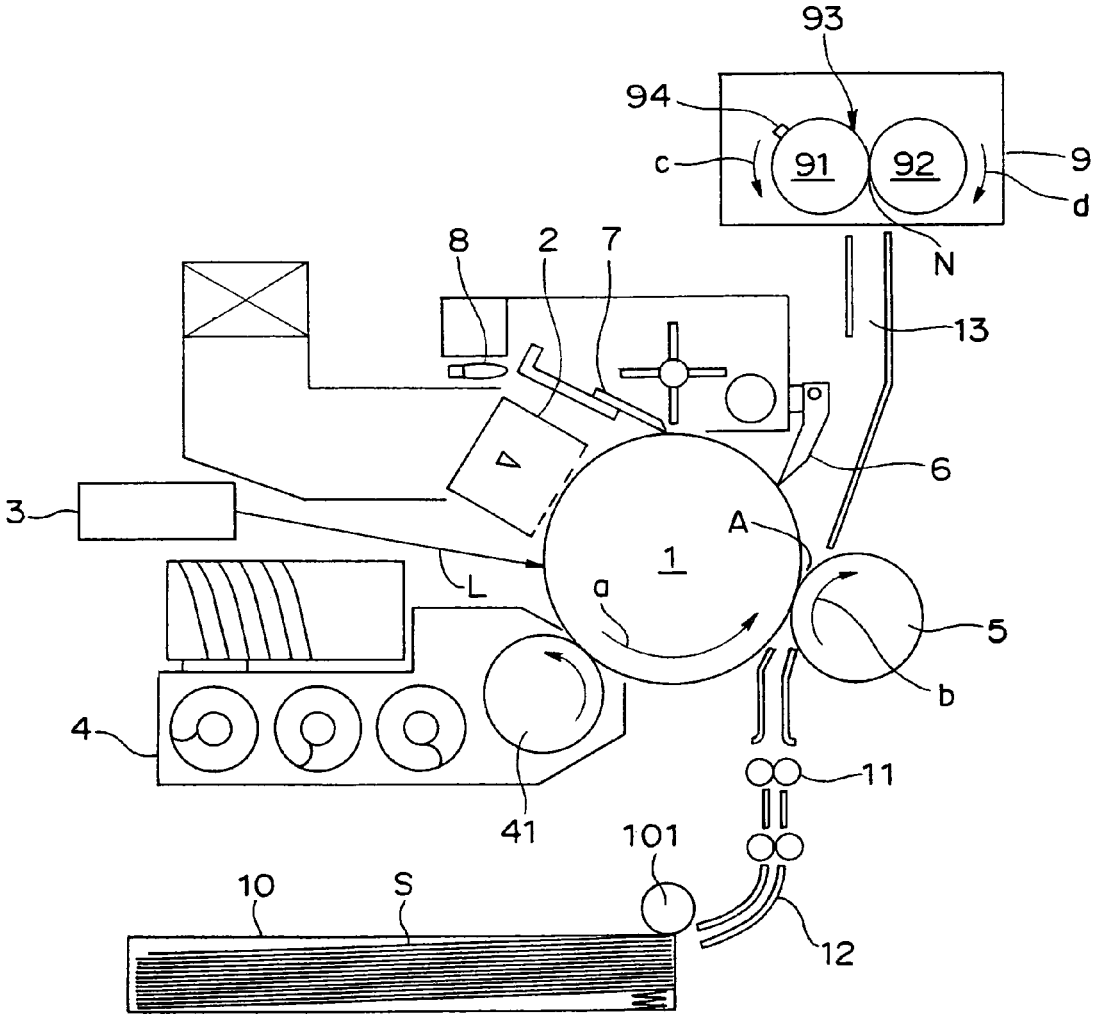
FIG. 1 is a view showing the structure of an image forming apparatus having a fixing device in one embodiment of the present invention.

With reference to FIG. 1, the structure of an image forming apparatus having a fixing device in one embodiment of the present invention is described as follows.

This image forming apparatus has a photoconductor drum 1 at the approximate center inside a casing (not shown), and a charging unit 2, an image exposure device 3, a developing device 4 having a developing roller 41, a transfer roller 5, a separating claw 6, a cleaner 7, and an eraser 8 are provided around the photoconductor drum 1 in this order. These components 1 to 8 constitute the image forming section. The photoconductor drum 1 and the transfer roller 5 are put in pressure contact with each other to form a nip section (transfer region) A for image formation.

A paper cassette 10 for storing a number of sheets (paper sheets etc.) S as recording media is placed below the transfer region A in the casing.

A fixing device 9 is placed above the transfer region A in the casing. The fixing device 9 has two members 91, 92 which are put in pressure contact with each other so as to form a nip section N for fixation. These members 91, 92 can respectively take the form of a cylindrical roller or an endless belt (the details will be described later). In this example, the member 91 is heated to fixing temperature by a later-described heating section. Placed around the member 91 are a separating claw 93 for separating the sheets S from the member 91 and a thermistor 94 for detecting the temperature of the member 91.

A conveyance path 12 for conveying the sheets S sent out from the paper cassette 10 is formed between the paper cassette 10 and the transfer region A. A conveyance path 13 for conveying the sheets S with toner attached thereto in the transfer region A is formed between the transfer region A and the fixing device 9.

At the time of image formation, the photoconductor drum 1 rotates in the direction of arrow a (counterclockwise in FIG. 1), and the transfer roller 5 rotates in the direction of arrow b (clockwise in FIG. 1), both around their respective centers. The surface of the photoconductor drum 1 is uniformly charged to a specified potential by the charging unit 2, and a laser beam L corresponding to a manuscript image is applied to the charged area from the image exposure device 3, by which an electrostatic latent image is formed on the surface of the photoconductor drum 1. The electrostatic latent image is developed into a visible toner image by the developing roller 41 of the developing device 4 with a developing bias applied thereto.

The sheets S are pulled out sheet by sheet from the paper cassette 10 into the conveyance path 12 by a feed roller 101, and a sheet is fed to a pair of timing rollers 11. The timing rollers 11 send the sheet S into the transfer region A in synchronization with formation of a toner image on the photoconductor drum 1 under the control by an unshown control section. Accordingly, the toner image formed on the photoconductor drum 1 is transferred and attached to the sheet S. The toner remaining on the surface of the photoconductor drum 1 after the transfer is cleaned and removed by the cleaner 7. The electric charge remaining on the surface of the photoconductor drum 1 is discharged and removed by the eraser 8. Thus, the preparation for the subsequent image formation is completed.

The sheet S with the toner image attached thereto is sent from the transfer region A to the nip section N between the two members 91, 92 of the fixing device 9 through the conveyance path 13. During fixing operation, the two members 91, 92 are rotated in the direction of arrow c, and the direction of arrow d, respectively. One member 91 is heated to fixing temperature by a heating section (e.g., a heater 95 in FIG. 2A). The temperature of the member 91 is subjected to feedback control by an unshown control section based on the temperature detected by the thermistor 94. The sheet S sent into the nip section N receives pressure and heat while being conveyed through the nip section N, by which the toner thereon is melted. Consequently, an image is fixed onto the sheet S. The sheet S with the image fixed thereon is discharged upward through the nip section N in this example.

Figure 2A:
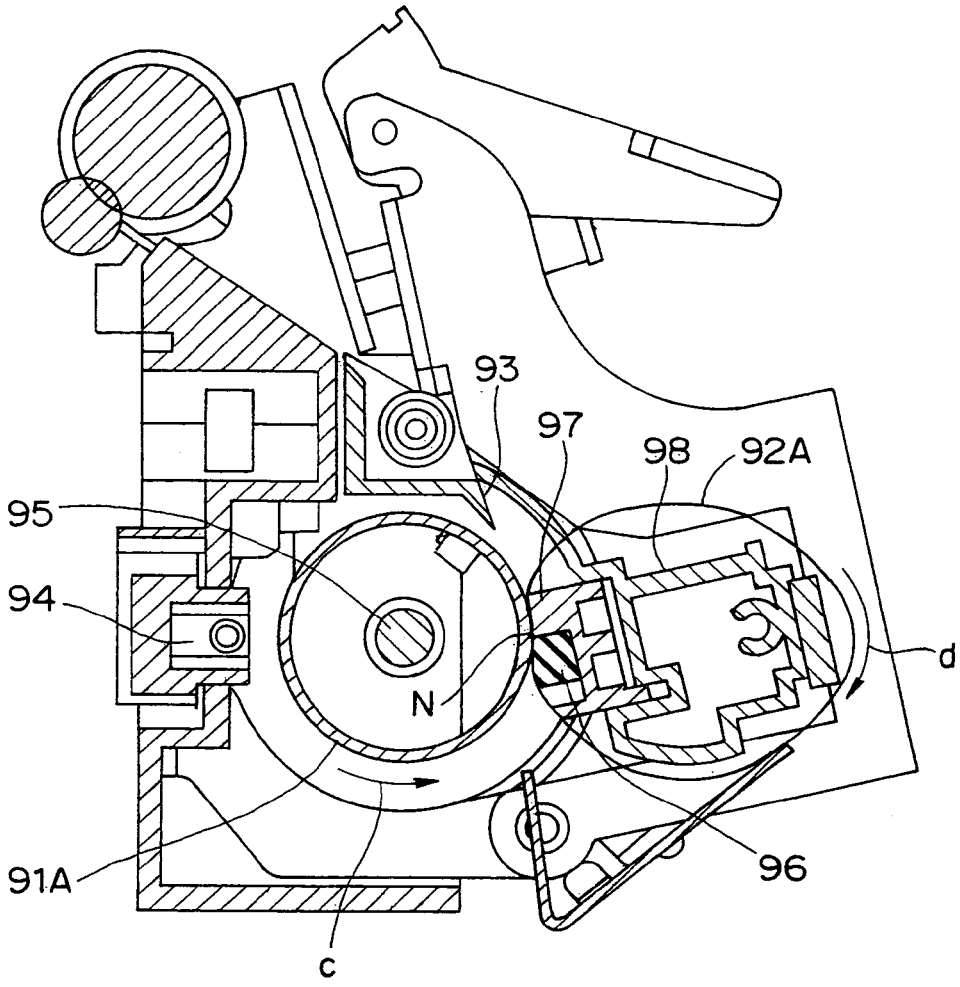
FIG. 2A is a view showing one specific structure example of the fixing device in FIG. 1.

Description is now given of a specific structure example of the above-mentioned fixing device 9 with reference to FIG. 2A. In this structure example, the fixing device 9 has a heating roller (shown with reference numeral 91A) which has the form of a cylindrical roller as the member 91, and a pressure belt (shown with reference numeral 92A) which has the form of an endless belt as the member 92. A heater 95 as a heating section is provided inside the heating roller 91A. Inside the pressure belt 92A, as a pressing member which presses the inner surface of the pressure belt 92A toward the heating roller 91A, an elastic pad 96 is provided in the upstream with respect to the sheet conveyance direction, and a rigid pad 97 is provided further in the downstream side. The elastic pad 96 and the rigid pad 97 are supported by the frame via a support member 98, and are biased toward the heating roller 91A. As a result, as shown in details in FIG. 2B, the pressure belt 92A is put in the state of being in pressure contact with the heating roller 91A, resulting in formation of a nip section N for fixation.

Figure 5A:
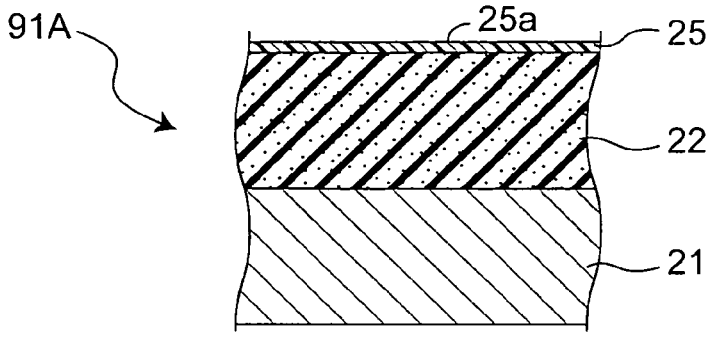
FIG. 5A is a view showing the section structure of a heating roller in FIG. 2A.

As shown in FIG. 5A, the heating roller 91A has a three-layer structure composed of a cored bar 21, a middle layer 22, and a surface layer 25 in this example.

The cored bar 21 is preferably made of metallic materials such as aluminum and iron so as to have mechanical strength. The cored bar 21 is in pipe shape and the thickness is about 0.1 mm to 5 mm in this example. The thickness of the cored bar 21 is preferably about 0.2 mm to 1.5 mm with consideration of weight saving and warm-up time.

The surface layer 25 is formed from a tube made of fluorine-based resin or a coating made of the same fluorine-based resin such as PFA (tetrafluoroethylene perfluoroalkyl vinyl ether copolymer), PTFE (polytetrafluoroethylene) and ETFE (ethylene tetrafluoroethylene) so that a surface 25*a* has releasability. The surface layer 25 may be made of resin such as silicone-based resin, and may have conductivity. The thickness of the surface layer 25 is preferably about 5 μm to 100 μm. The fluorine-based tube is exemplified by such products as PFA350-J, 451HP-J, 951H Plus made by Du Pont-Mitsui Fluorochemicals Company, Ltd. The angle of contact with water is 90 degrees or more, and is preferably 110 degrees or more. While the surface roughness of the surface layer 25 is optional in this example, it is preferable that the arithmetic-average-roughness Ra is about 0.1 μm to 1.3 μm.

The middle layer 22 is preferably made of materials having elasticity and high heat resistance such as silicone rubber and fluororubber. Although the thickness of the middle layer 22 is optional, the preferable thickness is about 0.05 mm to 2 mm. Although the outer diameter of the middle layer 22 is optional, the preferable outer diameter is about 10 mm to 50 mm. It is to be noted that the middle layer 22 may be omitted and the heating roller 91A may have two-layer structure instead.

Figure 5B:
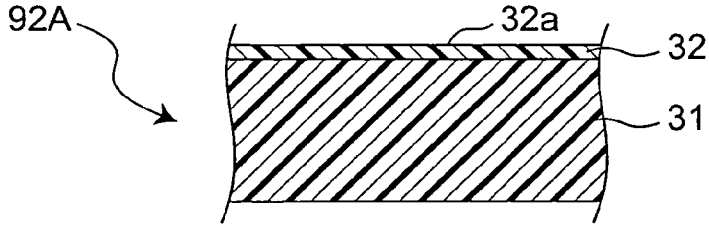
FIG. 5B is a view showing the section structure of a pressure belt in FIG. 2A.

As shown in FIG. 5B, the pressure belt 92A has two-layer structure composed of a base material 31 and a surface layer 32 in this example.

The base material 31 is made of materials such as polyimide, polyphenylene sulfido, nickel, iron, and stainless steel (SUS). Although the thickness of the base material 31 is optional, the preferable thickness is about 0.05 mm to 2 mm. Although the outer diameter of the base material 31 is optional, the preferable outer diameter is about 20 mm to 100 mm.

the surface layer 32 is formed from a tube made of fluorine-based resin such as PFA, PTFE and ETFE or a coating made of the same fluorine-based resin so that a surface 32*a* has releasability. The thickness of the surface layer 32 is preferably about 5 μm to 100 μm. The fluorine-based tube is exemplified by such products as PFA350-J, 451HP-J, 951H Plus made by Du Pont-Mitsui Fluorochemicals Company, Ltd. The angle of contact with water is 90 degrees or more, and is preferably 110 degrees or more. As for the surface roughness of the surface layer 32, the arithmetic average roughness Ra is 0.1 μm to 1.3 μm in this example. The effect of the surface roughness of the surface layer 32 will be described in details later.

It is to be noted that a middle layer may be provided between the surface layer 32 and the base material 31. The middle layer is preferably made of materials having elasticity and high heat resistance such as silicone rubber and fluororubber.

Figure 2B:
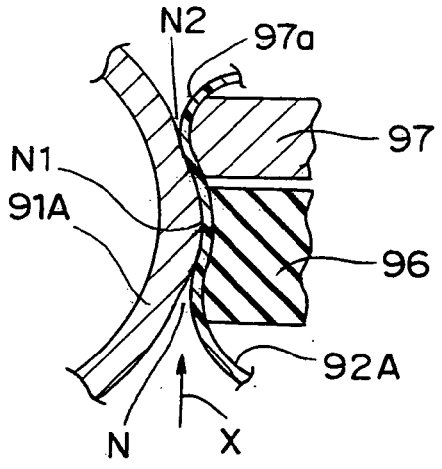
FIG. 2B is a detail view showing the vicinity of a nip section shown in FIG. 2A.

The elastic pad 96 shown in FIG. 2B is preferably made of materials having elasticity and high heat resistance such as silicone-based rubber and fluorine-based rubber. Although the thickness of the elastic pad 96 is optional, the preferable thickness is about 0.1 mm to 10 mm. The elastic pad 96 may be attached integrally with metal plates such as SUS, aluminum and iron from viewpoints of fitting property, productivity, and the like.

The rigid pad 97 is made of materials including resin such as polyphenylene sulfido, polyimide and liquid crystal polymer, metal such as aluminum and iron, and ceramics. A press surface (a surface coming into contact with the inner surface of the pressure belt 92A) 97*a* of the rigid pad 97 is formed protrusively so as to curve the pressure belt 92A in the state of protruding toward the heating roller 91A in a downstream end section N2 of the nip section N. As a result, in the cross sectional view of FIG. 2B, that is, in the cross sectional view as viewed along the width direction of the sheets conveyed through the nip section N, the downstream end section N2 of the nip section N curves protrusively along the press surface 97*a* of the rigid pad 97 in the direction opposite of a center section N1 of the nip section N with a radius of curvature smaller than that of the center section N1 of the nip section N.

It is to be noted that the nip section N can be deformed into various shapes corresponding to the shape of the elastic pad 96 and the rigid pad 97, the thickness of the middle layer (rubber layer) 22 of the heating roller 91A, the thickness and pressure of the elastic pad 96, or the like. Although the whole load of the fixing device which forms the nip section N is optional, it is preferable to be about 100N to 600N.

It is preferable to feed a lubricant such as grease and oil to between the inner surface of the pressure belt 92A and the press surface of the pressing members 96, 97 in order to enhance lubricity. Grease and oil may be made of any materials including fluorine-based materials, silicone-based materials, polyolefin-based materials and mineral oil-based materials.

Figure 6:
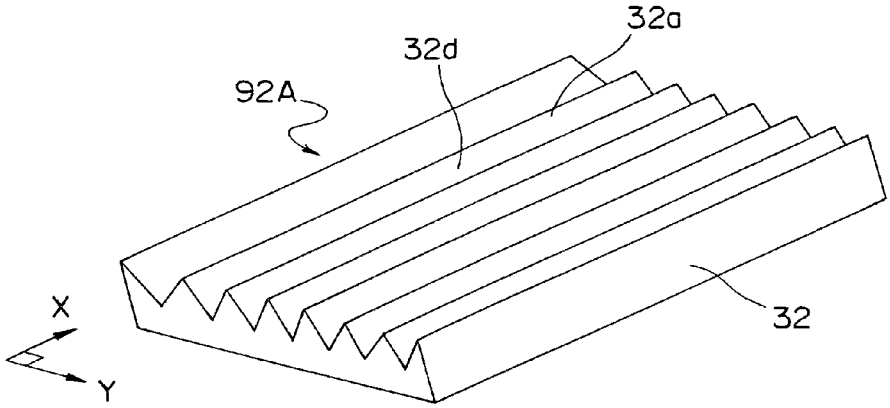
FIG. 6 is a schematic view showing the surface of the surface layer of a pressure belt in FIG. 2A.
Figure 7:
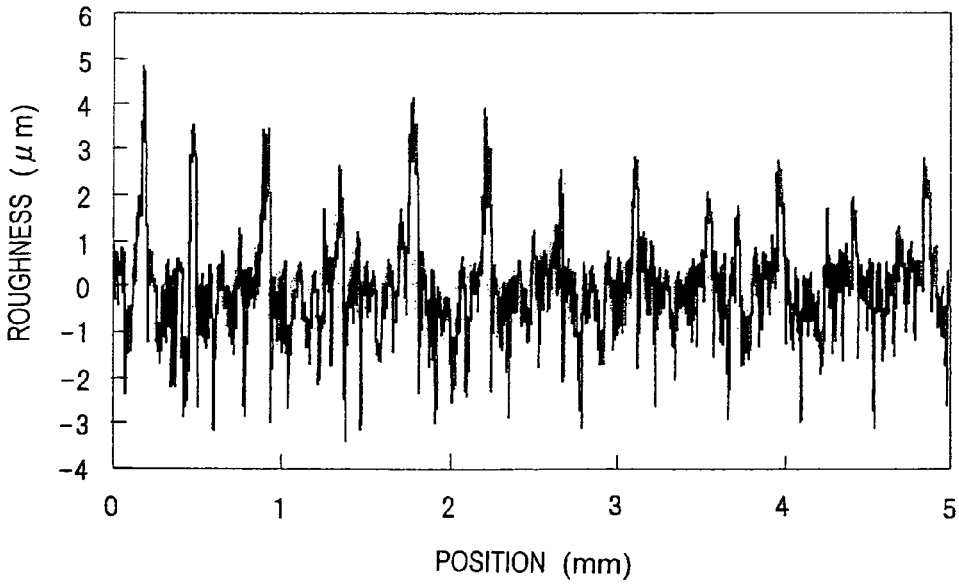
FIG. 7 is a view showing the unevenness of the surface of the pressure belt in FIG. 2A along a sheet width direction Y.

As described above, in the cross sectional view of FIG. 2B, that is, in the cross sectional view as viewed along the width direction of the sheets conveyed through the nip section N, the downstream end section N2 of the nip section N curves protrusively along the press surface 97*a* of the rigid pad 97 in the direction opposed to a center section N1 of the nip section N with a radius of curvature smaller than that of the center section N1 of the nip section N. This is for enhancing the sheet separating property. However, this gives the sheets a tendency to curve to and reversely wind around the pressure belt 92A. In the fixing device, the pressure belt 92A has the surface 32*a* (see FIG. 5B) which is made of fluorine-based resin as described before, and the arithmetic average roughness (Ra) of this surface is in the range of 0.1 μm to 1.3 μm. More specifically, as schematically shown in FIG. 6, the surface layer 32 of the pressure belt 92A has a plurality of grooves 32*d* which extend along the sheet conveyance direction X in the nip section N. As a result, the surface layer 32 of the pressure belt 92A has surface roughness seen as unevenness along the sheet width direction Y as shown in FIG. 7. It is to be noted that the horizontal axis in FIG. 7 shows a position on the surface 32*a* of the pressure belt 92A along the sheet width direction Y, and the vertical axis shows unevenness (roughness) of the surface 32*a* of the pressure belt 92A. It is to be noted that the pressure belt 92A may have unevenness with respect to the sheet conveyance direction X, and may have unevenness with respect to the conveyance direction X and the width direction Y. Thus, the surface 32*a* of the pressure belt 92A is made of fluorine-based resin, and the surface 32*a* has such unevenness as the arithmetic average roughness (Ra) of 0.1 μm or more, so that the sheet separating property can be improved. Furthermore, since the arithmetic average roughness (Ra) of the surface 32*a* is 1.3 μm or less, the releasability of toner and paper powder can be improved. As a result, generation of image noise and generation of a jam by winding caused by melting of toner can be prevented, and thereby the image quality and the paper feed reliability can be satisfied.

Description is now given of the experimental result showing the effect of the surface roughness of the pressure belt 92A with reference to FIG. 8. The leftmost column shows the number (from No. 1 to No. 11) of each sample produced for the experiment. As for the samples from No. 1 to No. 7, their surface materials are 100% fluorine-based resin (PFA in this example) with no additive. As for the samples from No. 8 to No. 11, their surface materials are PFA with 2.0 weight % carbon black as an additive. In the samples No. 1 and No. 2, the arithmetic average roughness Ra of their surfaces is 0.01 and 0.05, respectively, indicating that the surfaces are smooth. In the samples from No. 3 to No. 5, the arithmetic average roughness Ra of their surfaces are 0.10, 0.70, and 1.30 (within a preferable range), respectively. In the samples No. 6 and No. 7, the arithmetic average roughness Ra of their surfaces are 1.50 and 2.00, respectively, indicating that the surfaces are rougher. In the samples from No. 8 to No. 11, the arithmetic average roughness Ra of their surfaces is 0.02, 0.60, 1.20 and 1.80, respectively, indicating that they gradually change from the smooth state to the rougher state.

As is clear from the "quality" column in FIG. 8, in the samples from No. 3 to No. 5 (within a preferable range), test results regarding "releasability" of toner and paper powder, "separating property" of sheets, and "initial image noise" (image noise immediately after operation start) were all satisfactory (expressed by O), and so desirable results were obtained. On the contrary, in the samples No. 1 and No. 2 (having smooth surface), the result of "separating property" of the sheets was poor (expressed by x) and rather poor (expressed by Δ), respectively. In the samples No. 6 and No. 7 (having rougher surface), the result of "initial image noise" was rather poor (expressed by Δ) and poor (expressed by x), respectively.

In the samples from No. 8 to No. 11 (having additive), the result of "releasability" of toner and paper powder was poor (expressed by x), respectively. Furthermore, in the sample No. 8 (having smooth surface), the result of "separating property" of the sheets was poor (expressed by x), and in the sample No. 11 (having rougher surface), the result of "initial image noise" was poor (expressed by x) either. The tendency corresponding to the surface roughness in the sample groups from No. 8 to No. 11 is consistent with the tendency corresponding to the surface roughness in the sample groups from No. 1 to No. 7.

Thus, the result in FIG. 8 indicates that the desired quality can be obtained when the surface 32*a* of the pressure belt 92A is made of fluorine-based resin, and the surface 32*a* has such unevenness as the arithmetic average roughness (Ra) of 0.1 μm or more.

It is to be noted that although the heating source (heater 95) is provided only in the inside of the heating roller 91A in the above-mentioned structure example in FIG. 2A, a heating source may be placed inside the pressure belt 92A, for example, at the pressing members 96 and 97.

Although the heating roller 91A having the form of a cylindrical roller as the member 91 shown in FIG. 1 and the pressure belt 92A having the form of an endless belt as the member 92 are provided in the structure example of FIG. 2A, the present invention is not limited to this structure.

Figure 3:
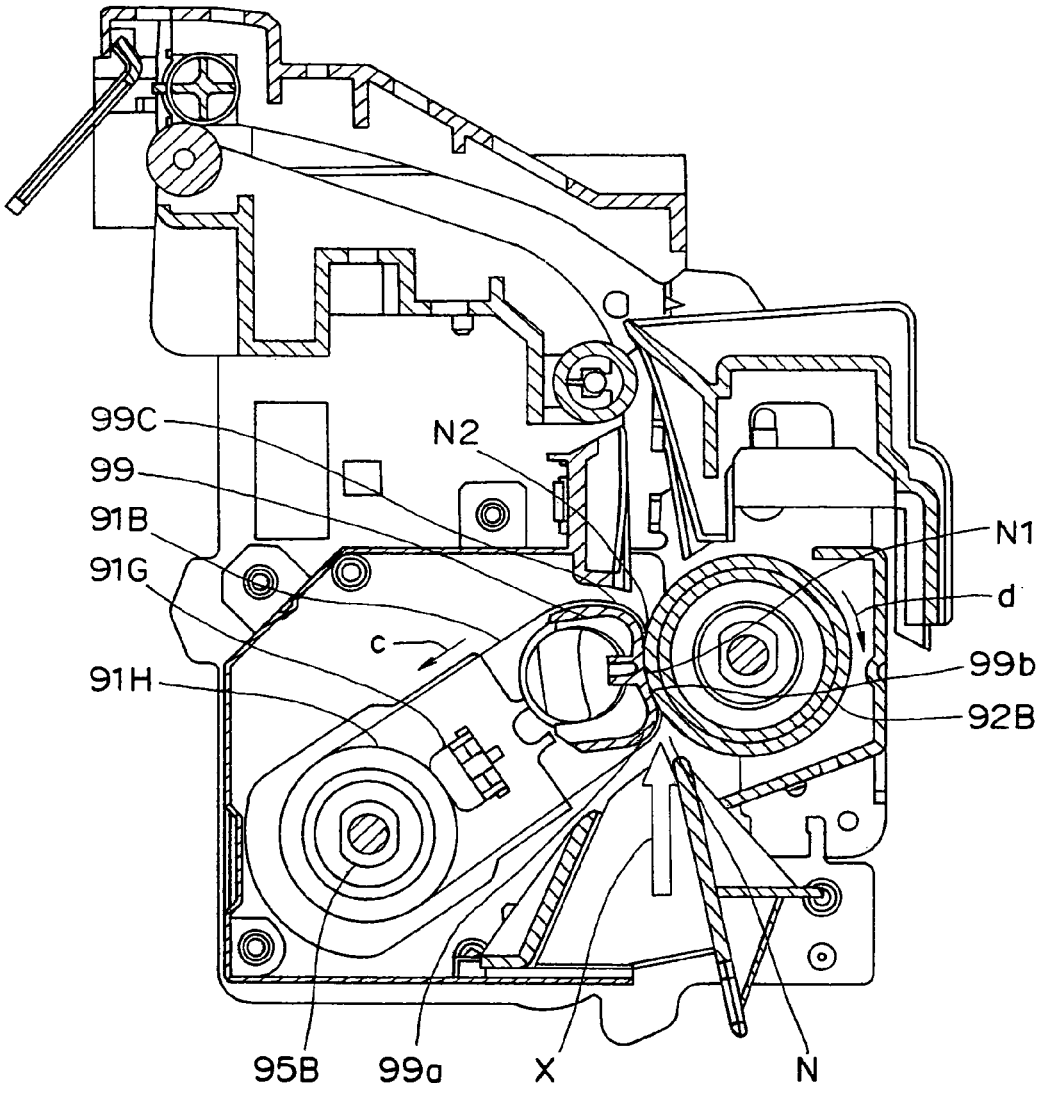
FIG. 3 is a view showing another specific structure example of the fixing device in FIG. 1.

For example, as shown in FIG. 3, a fixing belt 91B having the form of an endless belt as the member 91 shown in FIG. 1, and a pressure roller 92B having the form of a cylindrical roller as the member 92 may be provided. In the structure example of FIG. 3, a pressing member 99 and a heating roller 91H are placed inside the fixing belt 91B. The pressing member 99, which is supported by the frame, presses the inner surface of the fixing belt 91B toward the pressure roller 92B. The heating roller 91H is biased by a biasing member 91G in the direction away from the pressing member 99. This gives tension to the fixing belt 91B. A heater 95B is placed inside the heating roller 91H. During fixing operation, the heating roller 91H is heated by the heater 95B, and the fixing belt 91B is heated to the fixing temperature via the heating roller 91H.

The pressing member 99 is so structured that an upstream section 99*a* with respect to the sheet conveyance direction X is formed in the state of protruding toward the pressure roller 92B in a cross sectional view of FIG. 3, a center section 99*b* is formed into a recessed shape along the surface of the pressure roller 92B, and a downstream section 99*c* is formed in the state of protruding toward the pressure roller 92B.

In this example, the sheet with toner attached thereto is sent into the nip section N from the lower side. The sheet receives pressure and heat while being conveyed through the nip section N, by which the toner thereon is melted. Consequently, an image is fixed onto the sheet S. The sheet S with the image fixed thereon is discharged upward through the nip section N in this example.

The section structure of the fixing belt 91B is identical to the section structure of the pressure belt 92A shown in FIG. 5B, and the materials of the surface layer and the base material are also identical.

Figure 5C:
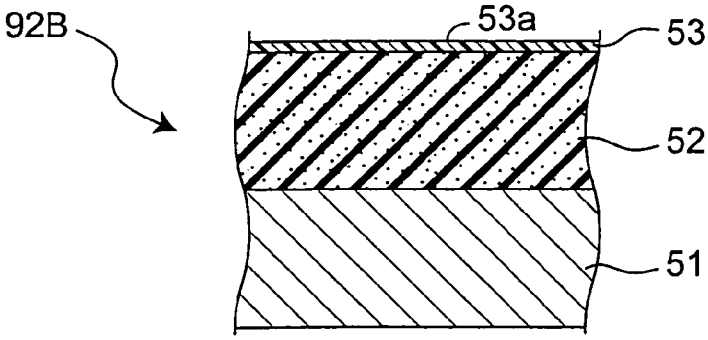
FIG. 5C is a view showing the section structure of a pressure roller in FIG. 3.

As shown in FIG. 5C, the pressure roller 92B has a three-layer structure composed of a cored bar 51, a middle layer 52, and a surface layer 53. Although the outer diameter of the pressure roller 92B is optional, the preferable outer diameter is about 20 mm to 50 mm. The pressure roller 92B may take a straight shape, a reverse crown shape with both ends having a larger diameter, and a crown shape with the center having a larger diameter. Although the difference in diameter is optional, it is typically about 0.001 mm to 3 mm.

The cored bar 51 is preferably made of metallic materials such as aluminum and iron so as to have mechanical strength. The cored bar 21 is in a pipe shape and the thickness is about 0.1 mm to 5 mm in this example. It is to be noted that the cored bar 21 may be solid and that the cross section thereof may be formed into atypical shapes such as a three arrow shape, which is formed by cutting away three peripheral portions from a circle. A heating source such as heaters may be placed inside the cored bar 21.

The middle layer 52, which is an elastic layer, may take either a solid or a sponge form. Although the thickness of the middle layer 52 is about 1 mm to 20 mm in this example, it may be changed corresponding to apparatuses where necessary. The middle layer 52 is preferably made of materials with high heat resistance such as silicone rubber and fluororubber, and additives may be added thereto. Roller hardness is optional.

The surface layer 53 is formed from a tube made of fluorine-based resin such as PFA and PTFE or a coating made of the same fluorine-based resin so that a surface 53*a* has releasability. The thickness of the surface layer 53 is preferably about 5 μm to 100 μm. The fluorine-based tube is exemplified by such products as PFA350-J, 451HP-J, 951H Plus made by Du Pont-Mitsui Fluorochemicals Company, Ltd. The angle of contact with water is 90 degrees or more, and is preferably 110 degrees or more. While the surface roughness of the surface layer 53 is optional in this example, it is preferable that the arithmetic-average-roughness Ra is about 0.1 μm to 1.3 μm.

In this example, in the cross sectional view of FIG. 3, that is, in the cross sectional view as viewed along the width direction of the sheets conveyed through the nip section N, a downstream end section N2 of the nip section N curves protrusively along the downstream section 99*c* of the pressing member 99 in the direction opposed to a center section N1 of the nip section N with a radius of curvature smaller than that of the center section N1 of the nip section N. This is for enhancing the sheet separating property. However, this gives the sheets a tendency to curve to and wind around the fixing belt 91B. Accordingly, in this example, the fixing belt 91B has a surface made of fluorine-based resin, and an arithmetic average roughness (Ra) of the surface is in the range of 0.1 μm to 1.3 μm. With this structure, all the quality items including "releasability" of toner and paper powder, "separating properties" of sheets, and "initial image noise" (image noise immediately after operation start) become satisfactory, and therefore desired quality can be obtained.

Figure 4:
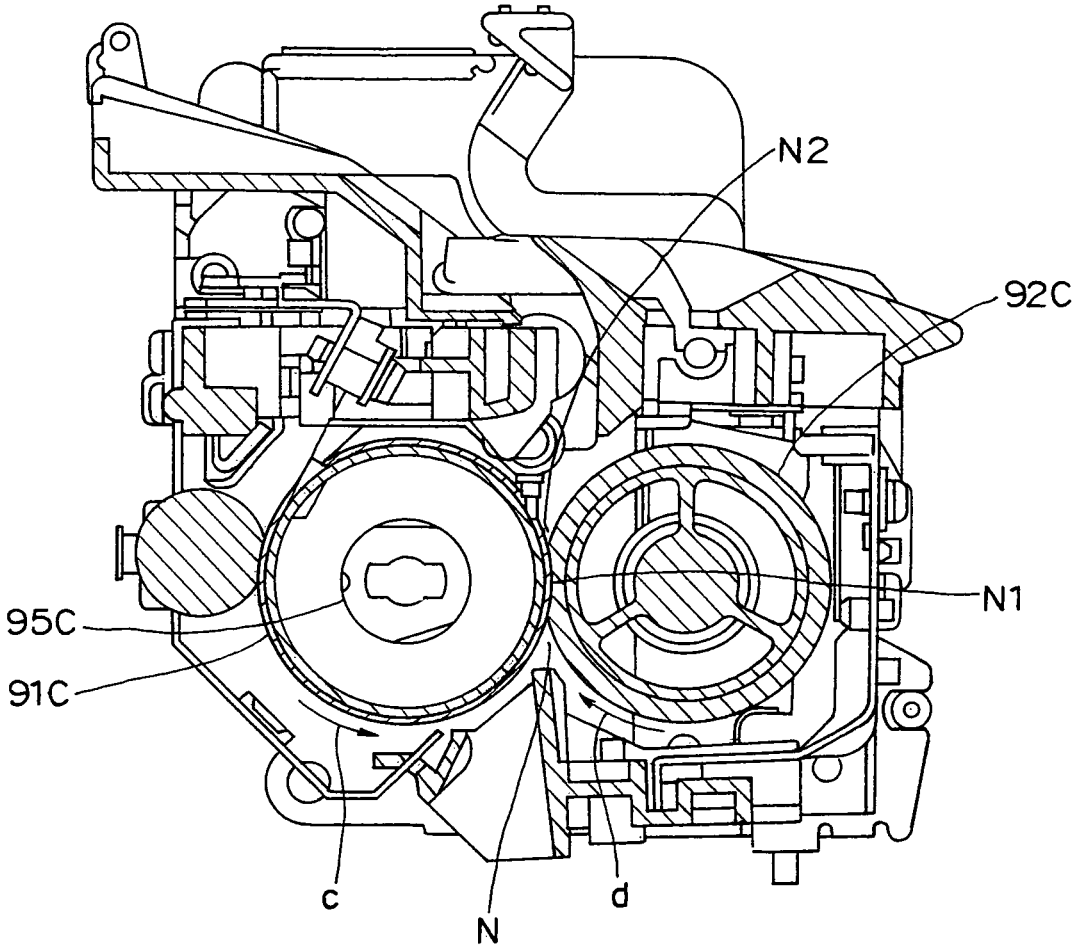
FIG. 4 is a view showing yet another specific structure example of the fixing device in FIG. 1.

Unlike the structure example in FIG. 2A and FIG. 3, a heating roller 91C having the form of a cylindrical roller as the member 91 shown in FIG. 1, that is a fixing member in this example, and a pressure roller 92C having the form of a cylindrical roller as the member 92 may be provided as shown in FIG. 4.

The section structure of the heating roller 91C is identical to the section structure of the heating roller 91A shown in FIG. 5A, and the materials of the surface layer, the middle layer and the cored bar are also identical. The section structure of the pressure roller 92C is also identical to the section structure of the pressure roller 92B shown in FIG. 5C, and the materials of the surface layer, the middle layer and the cored bar are also identical.

A heater 95C is placed inside the heating roller 91C shown in FIG. 4. During fixing operation, the heating roller 91C is heated to the fixing temperature with the heater 95C.

The sheet with toner attached thereto is sent into a nip section N formed by the heating roller 91C and the pressure roller 92C from the lower side in this example. The sheet receives pressure and heat while being conveyed through the nip section N, by which the toner thereon is melted. Consequently, an image is fixed onto the sheet S. The sheet S with the image fixed thereon is discharged upward through the nip section N in this example.

In this example, in the cross sectional view of FIG. 4, that is, in the cross section along the width direction of the sheets conveyed through the nip section N, the pressure roller 92C is pressed by the heating roller 91C and is depressed in the recessed shape. Consequently, the nip section N curves in the state of protruding toward the pressure roller 92C generally along the outer circumference face of the heating roller 91C. However, this gives the sheets a tendency to curve to and reversely wind around the heating roller 91C. Accordingly, in this example, the heating roller 91C has a surface made of fluorine-based resin, and an arithmetic average roughness (Ra) of the surface is in the range of 0.1 μm to 1.3 μm. With this structure, all the quality items including "releasability" of toner and paper powder, "separating properties" of sheets, and "initial image noise" (image noise immediately after operation start) become satisfactory, and therefore desired quality can be obtained.

It is to be noted that the pressure roller 92C, which is brought into contact with the heating roller 91C as a fixing member, may be replaced with a nonrotation elastic pad supported by the frame.

As described above, the fixing device makes it possible to improve the sheet separating property, and further improves the releasability of toner and paper powder. Therefore, the entire image forming apparatus structured as in FIG. 1 makes it possible to prevent generation of image noise and generation of a jam by winding caused by melting of toner, and to thereby satisfy the image quality and the paper feed reliability.

Description is now given of some methods for roughening the surface of a surface layer made of fluorine-based resin in order to manufacture members such as the heating roller 91A and the pressure belt 92A based on the structure example of FIG. 2A, the fixing belt 91B and the pressure roller 92B based on the structure example of FIG. 3, and the heating roller 91C and the pressure roller 92C based on the structure example of FIG. 4.

In the first method, first a base material having the form of a cylindrical roller or an endless belt is prepared. The base material having the form of a cylindrical roller may include a middle layer in addition to a cored bar. The base material having the form of an endless belt may include a middle layer. Then, fluorine-based resin is laminated as a surface layer so as to cover the outer circumference face of the base material. Then, the surface of the fluorine-based resin is roughened with use of lapping films, sandpaper, microfinishing films and the like so that the arithmetic average roughness thereof is in the range of 0.1 μm to 1.3 μm. As a result, members having desired surface roughness are obtained. The roughening can be made in any directions including a circumferential direction, a width direction and both the directions of the cylindrical roller or the endless belt.

It is to be noted that the surface of the fluorine-based resin may be roughened by pressing a roller and/on a sheet with an optional uneven shape. In this case, the surface layer may be heated together with the base material, or the roller and/on the sheet to be pressed may be heated so as to facilitate transfer of the uneven shape.

In the second method, first a tube which is made of fluorine-based resin having a smooth surface is formed by extrusion molding. Then, the surface of the tube is roughened with use of lapping films, sandpaper, microfinishing films and the like so that the arithmetic average roughness thereof is in the range of 0.1 μm to 1.3 μm. Then, a base material having the form of a cylindrical roller or an endless belt is prepared, and the tube is attached thereto as a surface layer so that the outer circumference face of the base material is covered. As a result, members having desired surface roughness are obtained.

It is to be noted that also in this method, the surface of the fluorine-based resin may be roughened by pressing a roller and/on a sheet with an optional uneven shape. In this case, the surface layer may be heated together with the base material, or the roller and/on the sheet to be pressed may be heated so as to facilitate transfer of the uneven shape.

In the third method, first a tube made of fluorine-based resin having a surface whose arithmetic average roughness is in a range of 0.1 μm to 1.3 μm is formed by extrusion molding. More specifically, an extrusion section is formed into an atypical shape having unevenness. Next, a base material having the form of a cylindrical roller or an endless belt is prepared, and the tube is attached thereto as a surface layer so that the outer circumference face of the base material is covered. As a result, members having desired surface roughness are obtained.

In the fourth method, first a base material having the form of a cylindrical roller or an endless belt is prepared. The outer circumference face of the base material is roughened. A tube made of fluorine-based resin having a smooth surface is formed by extrusion molding. The tube is attached as a surface layer to an outer circumference face of the base material. Accordingly, the roughened shape of the outer circumference face of the base material comes to be reflected upon the surface of the tube. The roughness of the outer circumference face of the base material is predetermined by experiments and the like so that the arithmetic average roughness of the surface of the tube is in the range of 0.1 μm to 1.3 μm when the tube is attached to the base material. As a result, members having desired surface roughness are obtained.

It is to be noted that what has been described herein is merely examples. The structure and the material of the apparatus are not limited to those disclosed herein. They can be changed corresponding to apparatuses where necessary.

The image forming apparatus may be any apparatus including monochrome/color copying machines, printers, facsimiles, and multi-functional machines having these functions.

As mentioned above, a fixing device of a first aspect of the present invention comprises:

two members which respectively have a form of a cylindrical roller or an endless belt and which are put in pressure contact with each other so as to form a nip section for fixation; and a heating source which heats at least one of the two members to fixing temperature, wherein in an end section corresponding to a downstream side of the nip section with respect to a conveyance direction of a sheet which is conveyed through the nip section, one member of the two members is curved in a state of protruding toward the other member in a cross sectional view as viewed along a width direction of the sheet, and wherein the one member has a surface made of fluorine-based resin, and an arithmetic average roughness of the surface is in a range of 0.1 μm to 1.3 μm.

It is preferable that the surface of the one member is made only of fluorine-based resin. The phrase "made only of fluorine-based resin" herein refers to the fact that the pertinent member does not contain any additive such as carbon black and made of 100% fluorine-based resin.

If the surface of the one member is made only of fluorine-based resin, Releasability of toner and paper powder can be further improved, and image quality and paper feed reliability can be further satisfied.

Preferably, the one member is formed from a base material and a tube composed of fluorine-based resin which is provided so as to cover an outer circumference face of the base material and which has a surface with the arithmetic average roughness.

Accordingly, the one member may be manufactured easily.

Preferably, the one member has a form of an endless belt, and there is provided a pressing member which presses an inner surface of the one member to the other member of the two members so as to form the nip section.

Therefore, the presence of the pressing member puts the two members in the state of being in pressure contact with each other, by which the nip section is formed.

Moreover, as mentioned above, a fixing device of a second aspect of the present invention comprises:

a fixing member which has a form of a cylindrical roller and whose outer circumference face is brought into pressure contact with a conveyed sheet; and a heating source which heats the fixing member to fixing temperature, wherein the fixing member has a surface made of fluorine-based resin, and an arithmetic average roughness of the surface is in a range of 0.1 μm to 1.3 μm.

It is preferable that the surface of the fixing member is made only of fluorine-based resin. As described above, the phrase "made only of fluorine-based resin" herein refers to the fact that the pertinent member does not contain any additive such as carbon black and made of 100% fluorine-based resin.

If the surface of the fixing member is made only of fluorine-based resin, Releasability of toner and paper powder can be further improved, and image quality and paper feed reliability can be further satisfied.

Preferably, the fixing member is formed from a base material and a tube composed of fluorine-based resin which is provided so as to cover an outer circumference face of the base material and which has a surface with the arithmetic average roughness.

Accordingly, the fixing member may be manufactured easily.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

The invention claimed is:

1. A manufacturing method for manufacturing one member out of two members comprised in a fixing device, the fixing device comprising the two members which respectively have a form of a cylindrical roller or an endless belt and which are put in pressure contact with each other so as to form a nip section for fixation, and a heating source which heats at least one of the two members to fixing temperature, the manufacturing method comprising:

forming a tube which is made of fluorine-based resin having a surface whose arithmetic average roughness is in a range of 0.1 μm to 1.3 μm by extrusion molding; and preparing a base material which has a form of a cylindrical roller or an endless belt and attaching the tube having the surface whose arithmetic average roughness is in the range of 0.1 μm to 1.3 μm to the base material as a surface layer so as to cover an outer circumference face of the base material.

2. A manufacturing method for manufacturing a fixing member comprised in a fixing device, the fixing device comprising the fixing member which has a form of a cylindrical roller and whose outer circumference face is brought into pressure contact with a conveyed sheet, and a heating source which heats the fixing member to fixing temperature, the manufacturing method comprising:

forming a tube which is made of fluorine-based resin having a surface whose arithmetic average roughness is in a range of 0.1 μm to 1.3 μm by extrusion molding; and preparing a base material which has a form of a cylindrical roller and attaching the tube having the surface whose arithmetic average roughness is in the range of 0.1 μm to 1.3 μm to the base material as a surface layer so as to cover an outer circumference face of the base material.

3. The manufacturing method according to claim 1, wherein the surface of the one member is made only of fluorine-based resin.

4. The manufacturing method according to claim 2, wherein the surface of the one member is made only of fluorine-based resin.

5. The manufacturing method according to claim 1, wherein the one member has a form of an endless belt, and wherein there is provided a pressing member which presses an inner surface of the one member to the other member of the two members so as to form the nip section.

6. The manufacturing method according to claim 1, wherein the forming of the tube comprises extrusion-molding the fluorine-based resin into the tube having the surface whose arithmetic average roughness is in the range of 0.1 μm to 1.3 μm.

7. The manufacturing method according to claim 2, wherein the forming of the tube comprises extrusion-molding the fluorine-based resin into the tube having the surface whose arithmetic average roughness is in the range of 0.1 μm to 1.3 μm.

* * * * *